United States Patent [19]

Maringer

[11] Patent Number: 4,617,981

[45] Date of Patent: Oct. 21, 1986

[54] METHOD AND APPARATUS FOR STRIP CASTING

[75] Inventor: Robert E. Maringer, Worthington, Ohio

[73] Assignee: Battelle Development Corporation, Columbus, Ohio

[21] Appl. No.: 148,359

[22] Filed: May 9, 1980

[51] Int. Cl.[4] ..... B22D 11/10; B22D 11/18

[52] U.S. Cl. ..... 164/453; 164/133; 164/423; 164/463; 164/437

[58] Field of Search ..... 164/87, 423, 427, 429, 164/437, 133, 335, 418, 453, 463

[56] References Cited

U.S. PATENT DOCUMENTS

| | | | |
|---|---|---|---|
| 903,758 | 12/1908 | Strange et al. | 164/87 |
| 993,904 | 5/1911 | Strange | 164/87 |
| 1,756,196 | 4/1930 | Hopkins et al. | 164/87 |
| 2,246,907 | 6/1941 | Webster | 164/155 X |
| 2,825,108 | 3/1958 | Pond | 164/82 X |
| 2,912,321 | 11/1959 | Brennan | 164/87 |
| 3,522,836 | 8/1970 | King | 164/87 |
| 3,587,718 | 6/1971 | Hopkins | 164/440 |
| 3,605,863 | 9/1971 | King | 164/4 X |
| 3,730,254 | 5/1973 | Namy | 164/155 X |
| 3,838,185 | 9/1974 | Maringer et al. | 164/87 X |
| 3,896,203 | 7/1975 | Maringer et al. | 164/87 X |
| 4,077,462 | 3/1978 | Bedell et al. | 164/424 |
| 4,142,571 | 3/1979 | Narasimhan | 164/429 X |
| 4,257,830 | 3/1981 | Tsuya et al. | 164/87 X |

*Primary Examiner*—Nicholas P. Godici
*Assistant Examiner*—Richard K. Seidel
*Attorney, Agent, or Firm*—Patrick J. Viccaro

[57] ABSTRACT

A method for continuously casting strip material onto a casting surface moving past a nozzle in a molten metal holding tundish is disclosed comprising the steps of pouring molten metal into the tundish at a rate sufficient to establish a metallostatic head pressure of at least one-quarter pound per square inch at the nozzle within one second after pouring is initiated, and pouring additional molten metal into the tundish at a rate sufficient to maintain a substantially constant operating pressure at the nozzle throughout the casting operation. A tundish for holding molten metal to be cast into strip material onto a casting surface moving past a nozzle in the tundish, is also disclosed comprising a front wall having an inside surface, a rear wall having an inside surface and sidewalls enclosing a molten metal holding area defined between the inside surfaces of the front and rear walls. The inside surface of the front wall converges with the inside surface of the rear wall at least at a location near the nozzle.

22 Claims, 7 Drawing Figures

METHOD AND APPARATUS FOR STRIP CASTING

BRIEF SUMMARY OF THE INVENTION

Incorporated herein, by reference, is the subject matter of co-filed U.S. patent applications entitled "Strip Casting Apparatus", Ser. No. 148,421 now abandoned; "Method of Repetitiously Marking Continuously Cast Metallic Strip Material", Ser. No. 148,448; "Apparatus for Strip Casting", Ser. No. 148,440 now abandoned; and "Strip Casting Nozzle", Ser. No. 148,441 now abandoned, all of which were filed May 9, 1980 and are assigned to the Assignee of the present application.

The present invention relates to the casting of relatively wide, thin metallic strip material at high quench rates and at high production rates. More particularly, the present invention is directed to a method and apparatus for obtaining and maintaining appropriate metallostatic head pressure at the nozzle during the continuous casting of strip material.

The advantages and economic significance of producing thin metallic strip material by a casting process, as compared to the conventional rolling or reducing operations, are apparent. The fact that strip casting is performed at sufficiently high quench rates to produce amorphous material is even more meaningful. However, it is equally apparent that there are a multitude of strip casting parameters which must be controlled or monitored to assure that the cast strip is of acceptable quality and of uniform composition and structure. For these reasons, those skilled in the art would appreciate the intricacy involved in the development of a commercially successful strip casting operation.

The general concept of casting thin metallic materials such as sheet, foil, strip and ribbon was disclosed in the early 1900's. For example, U.S. Pat. Nos. 905,758 and 993,904 teach processes wherein molten material is delivered onto a moving, relatively cool surface and the material is drawn and hardened thereon into a continuous thin strip. These references teach that molten metal may be poured or flowed from a crucible, or other receptacle, onto the smooth peripheral surface of a rotating liquid-cooled copper drum or disc to form strip materials. Despite early disclosure of such concept, there is no evidence of commercial success of strip casting during the early part of the 20th century.

Recently, in U.S. Pat. Nos. 3,522,836 and 3,605,863, a method for manufacturing a continuous product, such as metallic wire or strip, from molten metal has been disclosed. These references teach that a convex meniscus of molten material should project from a nozzle. A heat extracting surface, such as a water-cooled drum, is moved in a path substantially parallel to the outlet orifice and into contact with the meniscus of molten metal to continuously draw material and form a uniform continuous product. The above-described method is commonly called the "melt drag" process as the heat extracting surface moving past the meniscus of molten metal at the nozzle orifice actually has an effect on the rate of molten metal flow, or drag, through the nozzle.

More recent strip casting developments focus on refinements in the metallic strip casting art. For example, U.S. Pat. No. 4,142,571 is particularly directed to a specific construction for a slot in a metal strip casting nozzle having stringent dimensional requirements. Also, U.S. Pat. No. 4,077,462 pertains to the provision of specific construction for a stationary housing above the peripheral surface of a chill roll used for strip casting.

There are a number of other rapid quenching techniques known in the art. For example, melt spinning processes of producing metallic filament by cooling a fine molten stream either in free flight or against a chill block have been practiced. Also known in the art are melt extraction techniques, such as crucible melt extraction disclosed in U.S. Pat. No. 3,838,185 and pendant drop metal extraction as taught in U.S. Pat. No. 3,896,203. It has been found difficult to produce uniform sheet or strip by such alternative techniques of rapid casting. There are many factors, such as casting temperature, tundish and nozzle design, molten metal flow patterns, metal turbulance, metal pressure, auxiliary surface cooling, surface coatings and the like which appear to affect product thickness and quality of rapidly cast strip material.

Despite the relatively long history of the art of strip casting, and the recent developments in this area, strip casting is not a widely accepted and commercially significant operation at the present time. It appears that various improvements, modifications and innovations are required in the art to effectuate a significant commercial impact in the art of strip casting. For example, proper relationships among such variables as molten metal tundish construction, nozzle orifice size, spacing from a casting surface, speed at which such surface is moved, quench rate, metal feed rates, and the like will have to be determined in order to accomplish the uniformity and consistency required for successful, commercial production of cast strip.

The present invention is particularly directed to an improved method and apparatus for continuously casting strip onto a casting surface moving past a nozzle in a molten metal holding tundish. This invention is not directed to any particular nozzle which may be utilized in strip casting, but rather to the apparatus in which the molten metal is held prior to feeding of such metal through a nozzle located in a portion of the tundish.

Tundishes, or crucibles of the prior art, such as that disclosed in U.S. Pat. No. 4,077,462 are generally of uniform cross sectional construction, and are generally cylindrical or rectangular structures. However, overflow crucibles, such as that shown in U.S. Pat. No. 993,904, may also be employed for strip casting.

It has been found that the molten metal in the reservoirs of the prior art may have to be pressurized with external pressurizing equipment to adequately expel the metal through the nozzle, as taught in U.S. Pat. No. 4,142,571. It has also been found that it takes considerable time to fill the prior art crucibles to a height adequate to provide the head pressure necessary to expel the molten metal through the nozzle. Also molten metal flow patterns may cause casting problems, especially during the initiation of a strip casting process. Further, it has been found difficult to maintain relatively constant static head pressures by controlling molten metal height in the crucibles of the prior art, even in generally frustoconical tundishes such as that shown in U.S. Pat. No. 3,576,207.

Accordingly, a new and improved method for rapidly obtaining and adequately maintaining nozzle pressure and a new and improved tundish for holding molten metal to be cast into strip material through a nozzle located in a lower portion of the tundish are desired which overcome the disadvantages of the prior art, and contribute to uniformity and consistency in strip casting.

The present invention may be summarized as providing a method for continuously casting strip material onto a casting surface moving past a nozzle in a molten metal holding tundish comprising the steps of pouring molten metal into a tundish at a rate sufficient to establish a metallostatic head pressure of at least one-quarter pound per square inch at the nozzle within one second after pouring is initiated, and pouring additional molten metal into the tundish at a rate sufficient to maintain a substantially constant operating pressure at the nozzle throughout the casting operation. The invention is also directed to a tundish for holding molten metal to be cast into strip material through a nozzle located in a portion of the tundish. The tundish of the present invention comprises a front wall having an inside surface, a rear wall having an inside surface, and sidewalls enclosing a molten metal holding area defined between the inside surface of the front wall and the inside surface of the rear wall. The inside surface of the front wall converges with the inside surface of the rear wall at least at a location near the nozzle. In a preferred embodiment, the lateral distance between the converging front and rear walls progressively decreases in the direction of the nozzle.

Among the advantages of the present invention is the provision of an improved method and apparatus wherein a relatively constant metallostatic head pressure can be readily maintained at a nozzle located in a portion of the tundish used for strip casting.

An objective of the present invention is to eliminate the requirement for externally applying pressure to molten metal held in a tundish used for strip casting.

Another advantage of the present invention is that the metallostatic head pressure at a nozzle in a strip casting tundish can be rapidly created, without excessive molten metal turbulence, to quickly stabilize the strip casting operation after initiation thereof, resulting in little or no scrap material being cast.

These and other objectives and advantages will be more fully understood and appreciated with reference to the following detailed description and the accompanying drawings.

DETAILED DESCRIPTION

Figure 1:
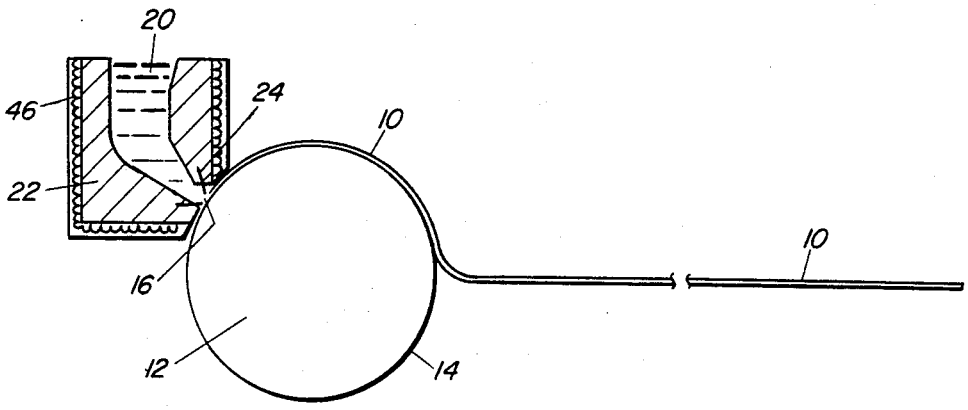
FIG. 1 is an elevation view, partially in cross-section, illustrating a typical unit used for continuously casting strip material.

Referring particularly to the drawings, FIG. 1 generally illustrates an apparatus for casting metallic strip material 10. This apparatus includes an element 12 upon which the strip 10 is cast. In a preferred embodiment a strip is cast onto a smooth, outer peripheral surface 14 of a circular drum or wheel as shown in FIG. 1. It should be understood that configurations other than circular may be employed. For example, a wheel with a smooth, frustoconical outer peripheral surface (not shown) may be utilized. Also, a belt which rotates through a generally ovular path may also be employed as the casting element.

In a preferred embodiment, the casting element 12 comprises a water cooled copper wheel. Copper is chosen for its high thermal conductivity, however, copper alloys, steel, brass, aluminum or other metals may also be employed alone or in combination. Likewise, cooling may be accomplished with the use of a medium other than water. Water is typically chosen for its low cost and its ready availability.

In the operation of the casting unit shown in FIG. 1, the surface 14 of the rotatable casting wheel 12 must be able to absorb the heat generated by contact with molten metal at the initial casting point 16, and such heat must be conducted substantially into the copper wheel during each rotation of the wheel. The initial casting point 16 refers to the approximate location on the casting surface 14 where molten metal 20 from the tundish 22 first contacts the casting surface 14. Cooling by heat conduction, may be accomplished by delivering relatively large quantities of water through internal passageways located near the periphery of the casting wheel 12. Alternatively, the cooling medium may be delivered directly to the underside of the casting surface. Understandably, refrigeration techniques and the like may be employed to accelerate or decelerate the cooling rates as may be desired during strip casting.

Whether a drum, wheel or belt is employed for casting, the casting surface 14 should be relatively smooth and symmetrical to maximize product surface uniformity in strip casting. For example, in certain strip casting operations the distance between the outer peripheral casting surface 14 and the surfaces defining the orifice of the nozzle through which molten material is fed from a tundish onto the casting surface 14, should not deviate from a desired or set distance. This distance shall hereinafter be called standoff distance or gap during the casting operation. It is understandable that the gap should be substantially maintained throughout the casting operation when producing strip of a uniform gage.

The molten material 20 to be cast in the apparatus described herein is preferably retained in a crucible 22, or tundish, which is provided with a pouring orifice 24 or nozzle. The nozzle is typically located at the lower portion of the tundish 22 but may be located at other positions such as in a sidewall.

Figure 2:
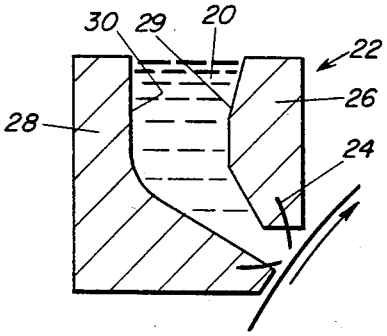
FIG. 2 is a cross-sectional view of a tundish of the present invention.
Figure 3:
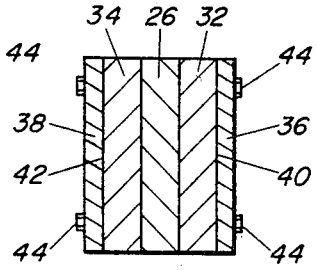
FIG. 3 is a front elevational view of the tundish shown in FIG. 2.
Figure 4:
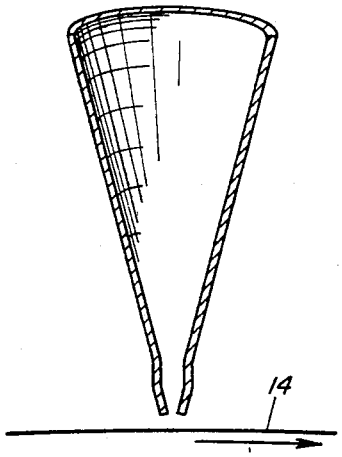
FIG. 4 is a cross-sectional view of an alternative tundish of the present invention.
Figure 5:
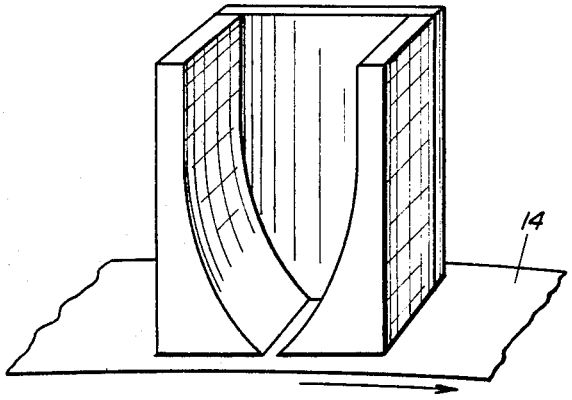
FIG. 5 is a cross-sectional view of an alternative tundish of the present invention.

The tundish 22 which holds the molten metal 20 to be cast into strip material, includes a front wall 26 and a rear wall 28 with respect to the strip casting direction indicated generally by the arrows in FIGS. 1 and 2. The front wall 26 and the rear wall 28 are provided with inside surfaces 29 and 30 with respect to the molten metal 20 holding area of the tundish 22.

The molten metal 20 holding area defined between the inside surfaces 29 and 30 of the front wall 26 and the rear wall 28 is enclosed by sidewalls 32 and 34. In a preferred embodiment the front wall 26 and rear wall 28 of the tundish 22 are separate parts that are sandwiched between two generally rectangular sidewalls 32 and 34. Metallic plates 36 and 38 may be disposed over at least a portion of the outside surfaces 40 and 42, respectively, of the sidewalls 32 and 34. Fasteners, such as bolts 44, may be inserted through the plates 36 and 38, and through at least a portion of the sidewalls 32 and 34, the front wall 26 and the rear wall 28 to assemble the tundish 22. Alternatively, the front wall 26, the rear wall 28 and the sidewalls 32 and 34 of the tundish 22 may be integrally constructed as a monolithic unit.

The inside surface 29 of the front wall 26 of the tundish 22 progressively converges with the inside surface 30 of the rear wall 28, from the upper portion of the tundish 22 in the direction of the nozzle 22, which is preferably located at a lower portion of the tundish 22. The progressive convergence of the inside surfaces 29 and 30 of the front wall 26 and the rear wall 28 is in the direction of the nozzle 24 of the tundish 22.

By the present invention, a metallostatic head pressure at the nozzle 24, of at least one-quarter pound per square inch must be obtained within one second after pouring of molten metal into the tundish is initiated. The importance of this limitation is to enable strip casting without the necessity of applying external pressure to the molten metal 20 in a tundish 22. Additionally, the method and apparatus of the present invention allow a significant amount of head pressure, i.e., greater than at least one-quarter psi and, more preferably, greater than one-half psi, to be obtained relatively quickly. The rapidity of attaining such pressure is beneficial in stabilizing the strip casting operation soon after starting the casting operation. By quickly stabilizing the operation, the amount of scrap material which is cast and which would interfere with, or even damage, the strip casting equipment, is minimized, and perhaps eliminated.

The inside surfaces 29 and 30 of the front and rear walls 26 and 28 progressively converge in the direction of the nozzle 24. A person skilled in the art can readily determine if the amount of convergence of such surfaces 29 and 30 is adequate, with respect to the molten metal pouring rate, by measuring the metallostatic head pressure above the nozzle 24. If the static head pressure is at least about one-quarter psi, or for example, one-half psi within one second after pouring is initiated, the amount of convergence is adequate, otherwise the amount of convergence is inadequate. The amount of convergence of surfaces 29 and 30 may provide the metallostatic head pressure of at least three-quarter pound per square inch, one pound per square inch, one and one-half pounds per square inch and two and one-half pounds per square inch. Preferably, the inside surfaces 29 and 30 converge sufficiently to obtain a static head pressure of at least about 2 psi within one second after pouring is initiated.

The progressive convergence of the inside surfaces 28 and 30 has the further advantage of minimizing molten metal turbulence during filling of the tundish 22, by directing metal flow in the direction of the nozzle 24. Furthermore, since the lateral distance between the inside surfaces 29 and 30 progressively decreases in the direction of the nozzle 24, the molten metal fills the holding area near the nozzle 24 relatively quickly, thereby progressively minimizing molten metal turbulence in the nozzle 24 area as the tundish 22 is filled. By such construction, the lateral distance between the facing inside surfaces of the tundish, at an operating location away from the nozzle is of sufficient width to minimize fluctuations in the metallostatic head pressure at the nozzle as the volume of metal in the tundish varies.

The crucible 22 is preferably constructed of a material having superior insulating ability. If the insulating ability is not sufficient to retain the molten material at a relatively constant temperature, auxiliary heaters such as induction coils 46 or resistance elements such a wires, may be provided in and/or around the tundish 22. A convenient material for the crucible is an insulating board made from fiberized koalin, a naturally occurring, high purity, alumina-silicon fire clay. Such insulating material is available under the trade name Kaowool HS board. However, for sustained operations various other materials may be employed for constructing the tundish and the nozzle including but not limited to graphite, alumina graphite, quartz, clay graphite, boron nitride, silicon carbide, silicon nitride, boron carbide, alumina, zirconia and various combinations or mixtures of such materials. It should also be understood that these materials may be strengthened; for example fiberized kaolin may be strengthened by impregnating with a silica gel, or the like.

Figure 6:
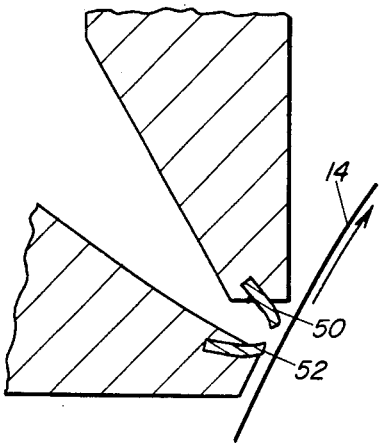
FIG. 6 is an enlarged cross-sectional view of a nozzle area of a tundish of the present invention.
Figure 7:
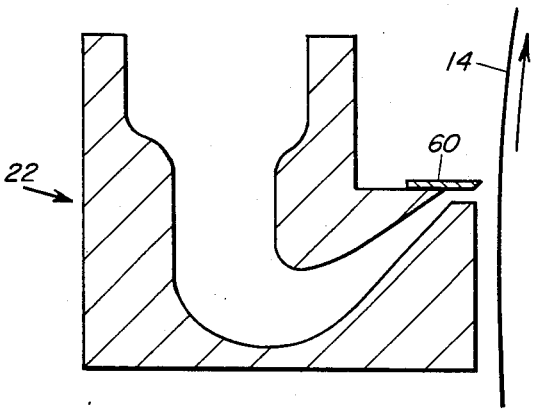
FIG. 7 is a cross-sectional view of an alternative tundish of the present invention.

It is imperative that the nozzle 24 orifice remain open and its configuration remain stable throughout a strip casting operation. It is understandable that the orifice should not erode or clog during a strip casting sequence or a primary objective of maintaining uniformity in the casting operation and minimizing metal flow turbulence in the tundish 22 may be defeated. Along these lines, it appears that certain insulating materials may not be able to maintain their dimensional stability over long casting periods. To obviate this problem, lips 50 and 52 as shown in an embodiment in FIG. 6 may be provided to form the orifice of the nozzle 24. Such lips 50 and 52 may be constructed of a material which is better able to maintain dimensional stability and integrity during exposure to high molten metal temperatures for prolonged time periods. Such materials may take the form of inserts held in the crucible, and may be constructed of materials such as quartz, graphite, boron nitride, alumina graphite, silicon carbide, stabilized zirconia silicate, zirconia, magnesia, alumina, or other molten metal resistant material. In a preferred embodiment illustrated in FIG. 7 an insert 60 made of molten metal resistant material may be disposed on the tundish 22 to form a critical part of the orifice of the nozzle 24.

In the operation of the casting apparatus of the present invention, it is beneficial to stabilize the casting parameters as soon as possible after commencing the operation. It is understandable that the sooner the parameters can be controlled, the less scrap or nonuniform strip material that is cast. Considering the relatively high strip casting rates, the benefits of quickly stabilizing the operation are more readily apparent. In this regard, it may be beneficial to preheat the tundish 22, especially the area about the nozzle 24 before the molten metal is poured therein. Such nozzle preheat may include heating the inner surfaces 29 and 30 of the tundish 22 nozzle to a temperature above the melting temperature of the metal to be cast into strip material. Such heat exposure may be accomplished with induction coils 46 or by inserting the tip of an ignited gas burner, such as an oxy-fuel, or oxygen-natural gas burner, into the crucible or placing such burner toward the nozzle of the crucible during casting. Such heating minimizes the possibility of the metal freezing, especially during start-up, and clogging. Nonuniform tundish, nozzle and orifice dimensions that may result from such freezing and/or clogging and which could otherwise adversely affect strip uniformity, are also minimized.

After the above preliminary or preparatory steps have been taken, molten metal is delivered to the crucible. It is understood that a heater, such as induction coils 46, may be provided in and above the crucible and/or the nozzle to maintain molten metal temperatures as may be desired. Alternatively, the molten metal may be poured directly into a preheated crucible. The preheat temperature should prevent freezing or clogging during the initial casting operation, and the temperature of the flowing metal may, thereafter, be sufficient to keep the tundish, nozzle and orifice at sufficient temperature to insure uninterrupted molten metal flow through the orifice. Preferably, the metal which is fed to the crucible may be superheated to allow a certain degree of temperature loss without adversely affecting metal flow. Molten metal delivered to the crucible preferably is retained at a substantially uniform temperature to assure that the quench rate and the quality of the strip is maintained during the casting operation.

Also, the metallostatic head height above the nozzle in the tundish 22, which establishes the corresponding metallostatic pressure at the nozzle, should be quickly attained at an average rate of pressure change of at least one quarter psi per second and may attain an average rate of pressure change of at least one-half psi per second or one psi per second or one and one-half psi per second, and preferably at an average rate of pressure change of at least two psi per second. The metallostatic head height should be maintained at a relatively constant level after initial start-up of the casting operation. This may be accomplished by initially pouring the molten metal into the crucible, at the rates discussed above, to the desired height and thereafter controlling the rate at which additional molten metal is poured into the crucible to maintain such desired metallostatic head height. The desired head height may be readily controlled by having a relatively wide holding area at such desired height in the tundish, such that variations in volume of molten metal have minor effect on head height and corresponding metallostatic pressure at the nozzle. Preferable the lateral distance between the facing inside surfaces of the tundish at an operating location away from the nozzle is sufficient to minimize the change in the metallostatic head pressure at the nozzle to less than 25% as the volume of metal in the tundish fluctuates by less than 50%. Preferably, the width of the tundish at the operating level is such that fluctuations in molten metal volume by as much as ten percent, have less than about one percent effect on the static pressure at the nozzle. It is understandable that the rate at which additional molten metal is fed to the tundish should be in substantial conformity with the rate at which metal flows from the nozzle orifice in forming strip material. Maintenance of a relatively constant height of metal in the crucible assures that the metallostatic head pressure at the nozzle is also maintained relatively constant so as not to adversely affect the casting operation or the quality of the cast strip material.

Using a tundish 22 similar to that shown in FIG. 2, made of a material commercially available under the tradename Garnex, a casting run was made on Type 304 stainless steel. The orifice at the base of the crucible was about 1.3 inches long by 0.08 inch wide, and the distance, or gap between the orifice and drum was between 0.02 and 0.04 inch. The speed of a rotating water cooled copper drum was about 930 feet per minute. The molten metal melt was poured into the tundish 22 at a temperature of about 2,900° F., estimated with the use of an optical pirometer. The metal was poured at a rate to establish a head height of about eight inches, yielding a nozzle pressure of about 2 psi, and such desired head height was attained within about one second after pouring was initiated. The cast strip exhibited fairly good quality. The strip was about 0.006 to 0.008 inch thick and was tough and ductile as cast.

Whereas the preferred embodiment has been described above for the purpose of illustration, it will be apparent to those skilled in the art that numerous variations of the details may be made without departing from the invention.

I claim:

1. A method for continuously casting strip material onto a casting surface moving past a nozzle in a molten metal holding tundish comprising the steps of:

pouring molten metal into the tundish at a rate sufficient to establish a metallostatic head pressure of at least one-quarter pound per square inch at the nozzle within one second after pouring is initiated, pouring additional molten metal into the tundish to effectuate an average rate of pressure change at the nozzle of at least one-quarter psi per second until the operating nozzle pressure of at least one-half pound per square inch is attained, and pouring additional molten metal into the tundish at a rate sufficient to maintain a substantially constant operating pressure at the nozzle through the casting operation.

2. A method as set forth in claim 1 wherein molten metal is poured into the tundish at a rate sufficient to establish a metallostatic head pressure of at least one-half pounds per square inch at the nozzle within one second after pouring is initiated.

3. A method as set forth in claim 1 wherein molten metal is poured into the tundish at a rate sufficient to establish a metallostatic head pressure of at least one pound per square inch at the nozzle within one seoond after pouring is initiated.

4. A method as set forth in claim 1 wherein molten metal is poured into the tundish at a rate sufficient to establish a metallostatic head pressure of at least one and one-half pounds per square inch at the nozzle within one second after pouring is initiated.

5. A method as set forth in claim 1 wherein molten metal is poured into the tundish at a rate sufficient to establish a metallostatic head pressure of at least two pounds per square inch at the nozzle within one second after pouring is initiated.

6. A method as set forth in claim 1 wherein molten metal is poured into the tundish at a rate sufficient to establish a metallostatic head pressure of at least two and one-half pounds per square inch at the nozzle within one second after pouring is initiated.

7. A method as set forth in claim 1 wherein molten metal is poured into the tundish at a rate sufficient to establish a metallostatic head pressure of at least three-quarter pound per square inch at the nozzle within one second after pouring is initiated.

8. A method as set forth in claim 1 wherein additional molten metal is poured into the tundish to effectuate an average rate of pressure change at the nozzle of at least one psi per second until the operating nozzle pressure of at least one psi is attained.

9. A method as set forth in claim 1 wherein additional molten metal is poured into the tundish to effectuate an average rate of pressure change at the nozzle of at least one and one-half psi per second until the operating nozzle pressure of at least one psi is attained.

10. A method as set forth in claim 1 wherein additional molten metal is poured into the tundish to effectuate an average rate of pressure change at the nozzle of at least two psi per second until the operating nozzle pressure is attained.

11. A method as set forth in claim 1 wherein the operating pressure is at least about two pounds per square inch.

12. A tundish for holding molten metal to be cast into strip material onto a casting surface moving past a nozzle in the tundish, comprising means for relatively quick stabilization of the pressure at the nozzle of at least one-quarter pound per square inch within one second after providing molten metal to the tundish, said means including a front wall having an inside surface with respect to a molten metal holding area of the tundish, a rear wall having an inside surface, and sidewalls enclosing a molten metal holding area defined between the inside surface of the front wall and the inside surface of the rear wall, said inside surface of the front wall converging with said inside surface of the rear wall at least at a location near the nozzle, said inside surfaces of the tundish at an operating location away from said nozzle at a lateral distance between the facing inside surfaces sufficient to minimize the change in the metallostatic head pressure at said nozzle to less than twenty-five percent as the volume of metal in the tundish fluctuates by less than fifty percent.

13. A tundish as set forth in claim 12 wherein the lateral distance between the front and rear walls progressively decreases in the converging portion of the tundish.

14. A tundish as set forth in claim 12 wherein the inside surface of the front wall is curvilinear.

15. A tundish as set forth in claim 12 wherein the inside surface of the rear wall is curvilinear.

16. A tundish as set forth in claim 12 wherein the sidewalls are generally planar.

17. A tundish as set forth in claim 16 wherein a metallic plate covering at least a majority of an outside surface of one sidewall is fastened through at least a portion of the sidewalls, and through the front wall and the rear wall, to a metallic plate covering at least a portion of an outside surface of the other sidewall.

18. A tundish as set forth in claim 12 wherein the front wall and rear wall of the tundish are separate parts sandwiched between two generally rectangular sidewalls.

19. A tundish as set forth in claim 12 wherein the molten metal holding area defined by the inside surfaces of the enclosed front wall, rear wall and sidewalls is generally frustoconical.

20. A tundish as set forth in claim 12 wherein the front wall, rear wall and sidewalls are integrally constructed as a monolithic container.

21. A tundish as set forth in claim 12 wherein the front wall, rear wall and sidewalls converge in the direction of the nozzle.

22. A tundish as set forth in claim 12 wherein the front wall, rear wall and sidewalls are constructed of a material selected from the group consisting of graphite, quartz, clay graphite, alumina graphite, fiberized kaolin, boron nitride, silicon nitride, silicon carbide, boron carbide, alumina, zirconia, magnesia and combinations thereof.

* * * * *